US005904157A

United States Patent [19]

Meseha et al.

[11] Patent Number: 5,904,157

[45] Date of Patent: May 18, 1999

[54] COPPER SURFACE PICKLING SYSTEM

[75] Inventors: George M. Meseha, Salem; Fausto V. Travares; Ramana V. Appadwedula, both of Norwich; Emory C. Brown, Lisbon, all of Conn.

[73] Assignee: Phelps Dodge Industries, Inc., Phoenix, Ariz.

[21] Appl. No.: 08/662,534

[22] Filed: Jun. 13, 1996

Related U.S. Application Data

[60] Provisional application No. 60/014,901, Apr. 5, 1996.

[51] Int. Cl.[6] ..... C23G 5/04

[52] U.S. Cl. ..... 134/3; 134/2; 134/41; 134/42

[58] Field of Search ..... 134/3, 2, 41, 42

[56] References Cited

U.S. PATENT DOCUMENTS 2,856,275 10/1958 Otto ..... 41/42
4,754,803 7/1988 Escobar, Jr. et al. ..... 164/452

*Primary Examiner*—Ponnathapura Achutamurthy
*Assistant Examiner*—T. D. Wessendorf
*Attorney, Agent, or Firm*—Fish & Neave; Robert R. Jackson; Keith A. Zullow

[57] ABSTRACT

A copper surface pickling process is improved by providing most of the oxidizing agent (such as hydrogen peroxide) used in the process in a separate bath following a primarily acid bath. The temperature of the separate hydrogen peroxide bath can be kept lower, which reduces hydrogen peroxide loss and therefore consumption. After the hydrogen peroxide bath, the copper surface is subjected to high pressure rinsing, including a final stage in which purified (e.g., distilled) water is used.

10 Claims, 2 Drawing Sheets

COPPER SURFACE PICKLING SYSTEM

CROSS REFERENCE TO RELATED APPLICATION

This application claims the benefit of United States provisional application No. 60/014,901, filed Apr. 5, 1996.

BACKGROUND OF THE INVENTION

This invention relates to treating copper surfaces, and more particularly to treating such surfaces to remove oxides and other impurities from them.

This invention has particular application to treating the surface of continuous copper rod of the type that is used to produce wire by drawing the rod down to the desired wire size. Although the invention will be described for the most part in relation to its use in this type of context, it will be understood that the invention is equally applicable to treating copper surfaces having other shapes, and whether continuous or not continuous.

A system for continuously casting a copper bar, reshaping that bar into a rod, and passing the rod through several surface treatment stages is shown in Escobar et al. U.S. Pat. No. 4,754,803, which is hereby incorporated by reference herein. The surface treatment is intended to remove oxides and other impurities from the surface of the copper rod. This is very important because if the surface of the rod is not sufficiently clean, wire drawn from the rod will not be satisfactory. For example, the wire drawing operation may work the rod surface imperfections and defects into the wire being produced, thereby increasing the risk of wire breakage, increasing the electrical resistance of the wire, etc.

The rod surface treatment process shown in the Escobar et al. patent has, as background, the pickling process shown in Otto U.S. Pat. No. 2,856,275, which is also incorporated by reference herein. Thus in the Escobar et al. patent the copper surface is exposed to a mixture of oxidizing and reducing agents in an aqueous solution. For example, the oxidizing agent may be hydrogen peroxide ($H_2O_2$), and the reducing agent may be sulfuric acid ($H_2SO_4$). The temperature of the oxidizing/reducing solution may be in the range from about 120° F. to about 160° F. It is believed that, in addition to oxidizing other impurities on the copper surface, the hydrogen peroxide oxidizes red cuprous oxide ($CU_2O$) on that surface to cupric oxide (CuO) . Then the sulfuric acid reduces the cupric oxide to dissolved copper sulfate.

After passing through the oxidizing/reducing solution, the copper surface is rinsed by passing it through a rinse bath and spray. The final step is application of a water-based wax solution, which coats and protects the finished copper surface.

While surface treatments of the type shown in the Escobar et al. patent and described above work well, there is always room for further improvement. For example, the relatively high temperature of the oxidizing/reducing solution tends to cause substantial vaporization and thereby effective loss of hydrogen peroxide from that solution. There is also room for improvement in the cleanliness and brightness of the copper surface produced.

In view of the foregoing, it is an object of this invention to provide improved systems for pickling copper surfaces.

It is another object of this invention to provide systems for treating copper surfaces so that those surfaces are cleaner and brighter than if prior surface treatments were used.

It is still another object of this invention to reduce consumption or loss of volatile oxidizing agents such as hydrogen peroxide in copper surface treatment processes that make use of such agents.

SUMMARY OF THE INVENTION

These and other objects of the invention are accomplished in accordance with the principles of the invention by providing copper surface treatment processes in which the copper surface is first exposed to substantially only a reducing agent (such as sulfuric acid ($H_2S0_4$) ) at a relatively high temperature (e.g., from about 70° C. to about 80° C. (158–176° F.)). Thereafter, the copper surface is passed through a separate oxidizing/reducing bath which has a relatively high concentration of an oxidizing agent such as hydrogen peroxide ($H_2O_2$), but which is maintained at a relatively low temperature to significantly reduce oxidizing agent loss due to decomposition and vaporization. For example, the temperature of this separate oxidizing/reducing bath is preferably in the range from about 40° C. to about 45° C. (104–113° F.). Because of the strong oxidizing character of this separate bath, it is sometimes referred to herein as simply an oxidizing bath.

After the oxidizing bath, the copper surface is exposed to much more thorough and vigorous rinsing than is conventionally employed. In particular, a rinse liquid such as water is sprayed at high pressure (and therefore high velocity) at all portions of the copper surface. For example, the rinse liquid may be sprayed at a pressure in the range from about 200 psig to about 280 psig. The temperature of the rinse liquid may be in the range from about 51° C. to about 54° C. (124°–129° F.). In an especially preferred embodiment two successive rinse sprays are used. The first rinse spray may have a relatively high volume at about 200 psig. The second rinse spray may have a lower volume but high purity at about 280 psig. For example, the second rinse spray may be of high-quality, pure, distilled water.

After rinsing, the copper surface may receive the conventional water-based wax coating.

As compared to the system shown in the Escobar et al. patent, another compartment has been added which contains an optimized mixture of oxidizing/reducing solution of hydrogen peroxide and sulfuric acid. In the Escobar et al. system the mixture of oxidizing/reducing agent is done in one stage, whereas in the present system two stages are used. In the first stage an optimized reducing process is accomplished in a tank that allows a higher temperature which permits a better reducing process. In the second stage, oxidation accomplished in a separate tank at a much lower temperature (achieved by a cooling system) of 40–45° C. results in a significant improvement in the surface finish due to the ability to use a higher concentration of hydrogen peroxide. This new process is accomplished at a considerably lower rate of consumption of hydrogen peroxide (about 50–60% less than in the Escobar et al. system).

The increase in residence time obtained from the new two-stage process makes it feasible to achieve total oxidation of copper dust and cuprous oxide. This total oxidation results in a significantly superior surface finish, whereas in the Escobar et al. process surface finish was inhibited by the presence of copper dust.

After passing through the oxidizing/reduction treatment processes, the copper surface is passed through a rinse bath as mentioned above and thereby exposed to high pressure sprays (200–280 psi). These high pressure sprays remove any entrainment of acid and peroxide and cleanse the surface free of any remnants of oxides sticking to the surface. Distillate from evaporators is used to supply the rinse sprays with pure water. The above treatment procedure enhances the copper surface. A recirculation system for the rinse bath provides initial spraying on the copper surface in addition to the high pressure sprays. In the concluding stage of the treatment, the copper surface is dipped in a bath of water-based wax which contains protective chemicals.

Further features of the invention, its nature and various advantages, will be more apparent from the accompanying drawings and the following detailed description of the preferred embodiments.

DETAILED DESCRIPTION OF THE PREFERRED EMBODIMENTS

Figure 1:
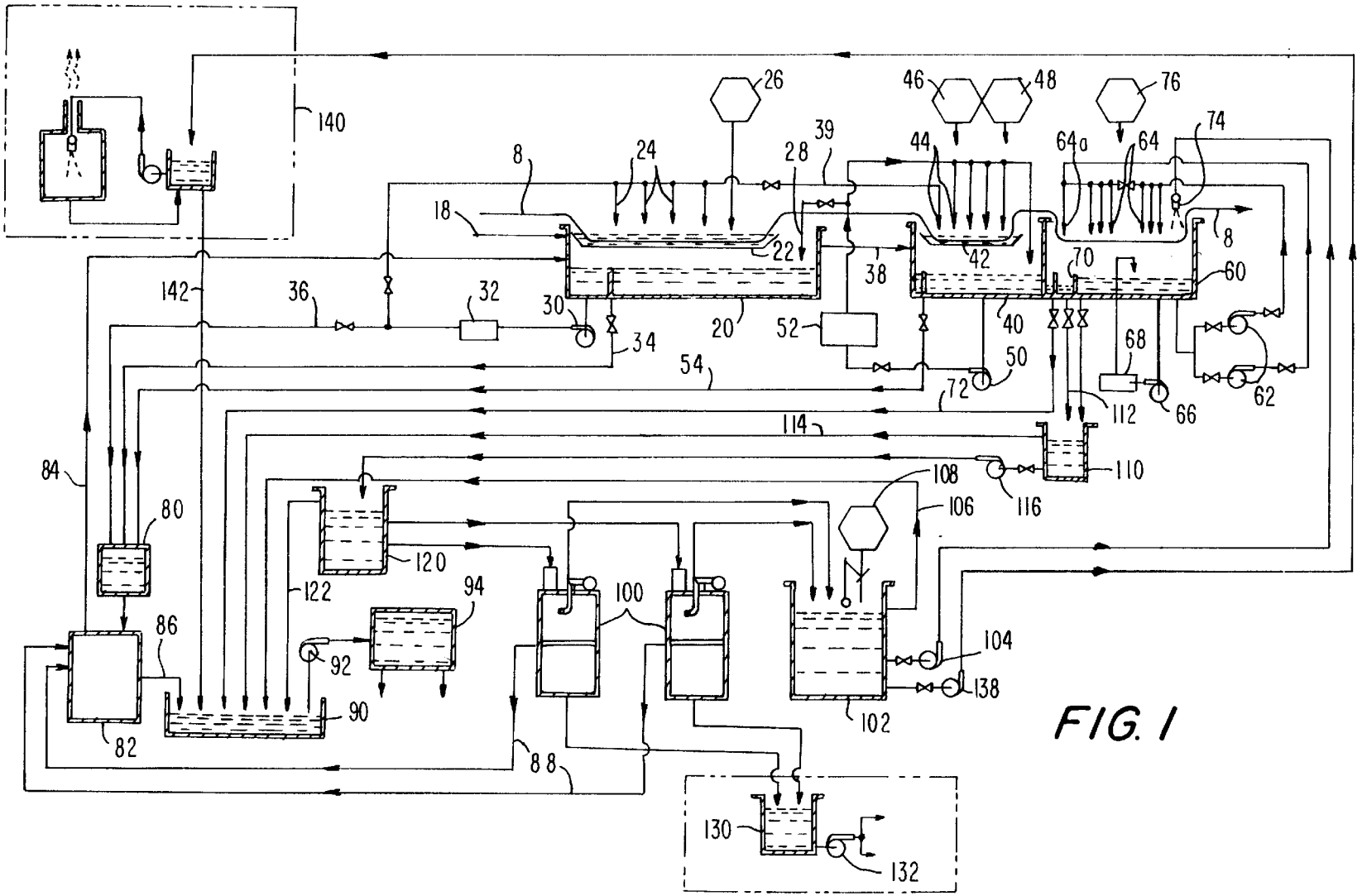
FIG. 1 is a schematic diagram of an illustrative embodiment of a copper surface treatment process in accordance with this invention.
Figure 2:
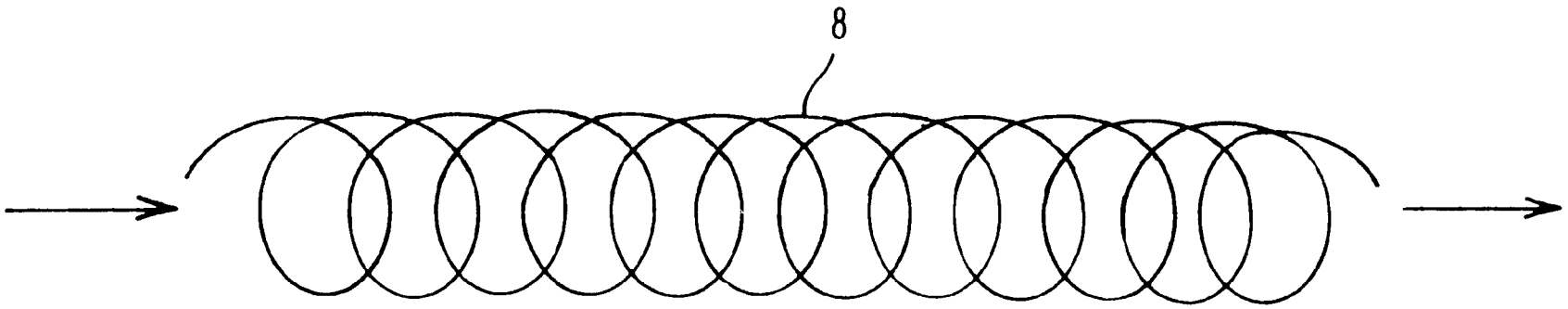
FIG. 2 is a simplified plan view of an illustrative copper structure treatable in the process illustrated in FIG. 1.

As shown in FIG. 1, the path of the copper surface (e.g., rod) to be treated is indicated by the line 8, which will be taken to represent the copper surface itself. For example, the copper surface may be partly coiled copper rod having a plan view appearance approximately as shown in FIG. 2. The rod may be approximately 8 mm in diameter, and the convolutions of the coil may be approximately 1.10 to 1.17 meters across. The partly coiled copper rod may be conveyed through the apparatus on a conveyor (not shown separately from copper surface 8). The copper rod may pass through the apparatus at a rate of approximately 60 tons per hour.

FIG. 1 shows that the copper rod passes successively through acid tank 20, peroxide tank 40, and rinse tank 60. More particularly, the copper rod passes through an upper, relatively shallow tray 22 in acid tank 20, and through a similar relatively shallow upper tray 42 in peroxide tank 40. A reducing solution is continuously sprayed into tray 22 via nozzles 24. The reducing agent in this solution may be sulfuric acid from make-up sulfuric acid supply 26. If desired, oxidizing agent (e.g., a solution of hydrogen peroxide) may be transferred from tank 40 to tank 20 via nozzle 28. However, the action of tank 20 is predominantly reducing, and so the solution in tank 20 is generally referred to herein as a reducing solution or an acid bath. Solution that overflows from tray 22 is caught by tank 20 and recirculated to tray 22 by pump 30. Heater 32 maintains the reducing solution in tank 20 at the desired temperature, preferably in the range from about 70° C. to about 80° C. (158–176° F.). Line 18 illustrates that some liquid may be carried into tank 20 by the copper rod from upstream apparatus.

In an illustrative embodiment (for processing the above-described 8 mm diameter copper rod at approximately 60 tons per hour), tank 20 is a 15,000 liter (4000 gallon) reservoir containing a sulfuric acid solution at a concentration of about 190–250 grams/liter (25–33 ounces/gallon), plus a small percentage of hydrogen peroxide (e.g., about 0.3% to 1.0% (3–10 grams/liter)). In addition to being submerged in the reducing solution, the surface of the copper rod is sprayed with that solution by the action of pump 30 and nozzles 24. This spray also beneficially agitates the solution in tray 22. For example, pump 30 may pump the reducing solution at a rate of approximately 60 cubic meters/hour (265 gallons per minute) and at a pressure of approximately 1 bar (15 psig). The pickling reaction that takes place in tank 20 removes scale and oxides from the copper surface.

Because the acid in tank 20 accumulates dissolved copper sulfate, the fluid is changed by tapping a portion of the volume to a conventional electrolytic recovery operation via conduit 34 and/or 36. This recovery operation includes retention tank 80 feeding conventional pickle recovery process 82. Reusable pickling solution recovered by process 82 is returned to tank 20 via conduit 84. Liquid that is not reusable in tank 20 is sent to sump 90 via conduit 86. Excess copper is removed as cathodes from the pickle cells. Make-up fluid for tank 20 is taken from peroxide tank 40 (via conduit 28) and some fresh acid from supply 26.

From acid tank 20 the coiled copper rod 8 is conveyed to and through the tray 42 in peroxide tank 40. In the above-mentioned illustrative embodiment, tank 40 holds about 4560 liters (1200 gallons) of hydrogen peroxide solution. Free acid in tank 40 may be in the range from about 100 to about 160 grams/liter. At the preferred temperature (in the range from about 40° C. to about 45° C. (104–113° F.)), the preferred hydrogen peroxide concentration is 1% to 3% (about 10.00 to 30.00 grams/liter). In addition to passing through the hydrogen peroxide bath in tray 42, the copper surface receives a spray of the hydrogen peroxide solution from nozzles 44. In the abovementioned illustrative embodiment this spray is at a rate of about 40 cubic meters per hour (176 gallons per minute) and a pressure of about 3 bar (44 psig). This flow rate and pressure are provided by pump 50, which pumps peroxide solution from tank 40 through heat exchanger 52 to nozzles 44. Heat exchanger 52 maintains the above-mentioned desired temperature of the peroxide solution. Peroxide solution that overflows tray 42 falls down into tank 40. Make-up hydrogen peroxide is supplied to tank 40 from hydrogen peroxide supply 46. Make-up water is supplied from water supply 48. Line 38 indicates that some liquid may be carried from tank 20 into tank 40 by the copper rod being processed. Transfer line 39 is used to maintain levels and free acid concentration in tank 40.

Because most of the hydrogen peroxide is now employed in a separate step (i.e., in tank 40 rather than in tank 20), the hydrogen peroxide in tank 40 can be maintained at a lower temperature than if it were in tank 20 as in the prior processes. Because the temperature of most of the hydrogen peroxide is thus lower, overall hydrogen peroxide stability is greater. This reduces the rate of hydrogen peroxide consumption and makes the process more economical.

In order to maintain a desirable concentration of free sulfuric acid (100–160 grams/liter), the fluid in tank 40 must be changed. This is done by conveying "overflow" fluid (above a certain level in tank 40) via conduit 54 to the above-described recovery system.

From tank 40 the coiled copper rod 8 travels through rinse tank 60. The rinse tank has two stages of water rinsing. In the first stage the entire surface of the copper rod is sprayed via nozzles 64 with rinse water that is recirculated from tank 60 by pumps 62. Nozzles 64 are directed so that all portions (i.e., the full circumference) of the surface of the copper rod are sprayed. Thus various nozzles 64 are strategically positioned to contact all angles around and between the convolutions of copper rod 8. Pump 66 and heater 68 are used to maintain the water in tank 60 at the desired temperature (preferably in the range from about 51° C. to about 54° C. (124–129° F.). Pumps 62 cause nozzles 64 to spray the surface of the copper at a high velocity with a high volume and high pressure. For example, in the illustrative embodiment for processing 8 mm diameter copper rod at 60 tons per hour, pumps 62 pump 91 cubic meters per hour (400 gallons per minute) at 15 bar (220 psig). Initial high-velocity nozzles 64*a* are preferably positioned so that the bulk of the chemicals carried in from the prior tank are washed off and collected in an initial portion of tank 60 to the left of weir 70. Some of the expended rinse water from this portion of tank 60 is conveyed to sump 90 via conduit 72. The waste fluids in sump 90 are treated in effluent treatment system 94.

The second, downstream, stage of the rinsing operation is performed by purified (i.e., distilled) rinse water from nozzles 74. This purer rinse water is supplied from evaporators 100 and potable water tank 102. Pump 104 pumps this water to the high pressure desired for use with nozzles 74. In an illustrative embodiment, for example, pump 104 pumps 9 cubic meters per hour (40 gallons per minute) at 19 bar (280 psig). This second stage of the rinsing operation ensures that the copper rod has a final fresh water flush. The combination of the use of the pure distilled water and the high pressure spray leaves the copper rod with an extremely clean, bright surface.

There is continuous blow down of 40 gallons per minute from rinse tank 60 which is evaporated in a vacuum evaporative system 100. This blow down ensures that the quality of the rinse bath is maintained to ensure good cleaning of the rod. Any evaporative loss is made up by the permeate from a reverse osmosis system (one of the units of effluent treatment system 94) and water supply 76. The principal flow from tank 110 is sent by pump 116 to feed tank 120 which supplies the rinse fluids to the vacuum evaporators 100. The distillate from the evaporators is stored in tank 102 which supplies the pure distillate to tank 60. Concentrate from the vacuum evaporators is passed through the electrolytic recovery system 82 via conduits 88. Evaporators 100 can be periodically drained to sump 130, from which pump 132 supplies the fluid to sump 90.

A small quantity of distilled water from tank 102 may be pumped by pump 138 to a conventional scrubber system 140. Scrubber system 140 may scrub vapors from the process for release to the atmosphere. Spent liquid from scrubber system 140 flows to sump 90 via conduit 142.

Sump 90 is pumped out by pump 92 to a conventional effluent treatment system 94.

From rinse tank 60 the copper rod 8 is conveyed to a conventional wax tank (not shown). As a result of the process improvements described above, the rod entering the wax tank is clean and thoroughly rinsed. The rod surface quality is improved, and the rod has a more uniform appearance and superior finish.

It will be understood that the foregoing is only illustrative of the principles of the invention, and that various modifications can be made by those skilled in the art without departing from the scope and spirit of the invention. For example, the particular routings shown for many of the liquids in FIG. 1 are only illustrative, and other routings can be used instead if desired.

The invention claimed is:

1. A method of treating a copper surface comprising the steps of:

exposing said surface to an acid bath which comprises about 190–250 grams of sulfuric acid per liter and about 3–10 grams of hydrogen peroxide per liter, said acid bath having a temperature in the range from about 70° to about 80° C.;

thereafter exposing said surface to a separate oxidizing bath which comprises about 10–30 grams of hydrogen peroxide per liter, said oxidizing bath having a temperature in the range from about 40° C. to about 45° C.; and thereafter rinsing said surface with high pressure jets of rinsing water, thereby removing oxides from the copper surface.

2. The method defined in claim 1 wherein said rinsing water is pressurized to about 200–280 psi.

3. The method defined in claim 2 wherein said water has a temperature in the range from about 51° C. to about 54° C.

4. The method defined in claim 2 wherein said rinsing step comprises the steps of:

initially rinsing said surface with high pressure jets of rinsing water that is primarily recirculated in said rinsing step; and thereafter finally rinsing said surface with high pressure jets of purified water.

5. The method defined in claim 4 wherein said purified water has been purified by distillation.

6. Apparatus for treating a copper surface comprising:

means for exposing said surface to an acid bath which comprises about 190–250 grams of sulfuric acid per liter and about 3–10 grams of hydrogen peroxide per liter, said acid bath having a temperature in the range from about 70° to about 80° C.;

means for exposing said surface to a separate oxidizing bath after said surface has been operated on by said means for exposing to an acid bath, said oxidizing bath comprising about 10–30 grams of hydrogen peroxide per liter and having a temperature in the range from about 40° C. to about 45° C.; and means for rinsing said surface with high pressure jets of rinsing water after said surface has been operated on by said means for exposing to an oxidizing bath, thereby removing oxides from said surface.

7. The apparatus defined in claim 6 wherein said rinsing water is pressurized to about 200–280 psi.

8. The apparatus defined in claim 7 wherein said water has a temperature in the range from about 51° C. to about 54° C.

9. The apparatus defined in claim 7 wherein said means for rinsing comprises:

means for initially rinsing said surface with high pressure jets of rinsing water that is primarily recirculated in said means for rinsing; and means for finally rinsing said surface with high pressure jets of purified water.

10. The apparatus defined in claim 9 further comprising:

means for distilling a portion of said water in said means for rinsing to produce said purified water.

* * * * *